US006359557B2

(12) United States Patent
Bilder

(10) Patent No.: US 6,359,557 B2
(45) **Date of Patent: *Mar. 19, 2002**

(54) MONITORING AND NOTIFICATION METHOD AND APPARATUS

(75) Inventor: Mitchell K. Bilder, Manalapan, NJ (US)

(73) Assignee: AT&T Corp, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/013,779

(22) Filed: Jan. 26, 1998

(51) Int. Cl.[7] ..... G08B 1/00; G08B 23/00

(52) U.S. Cl. ..... 340/531; 340/573.1; 455/405; 709/224; 713/201; 725/9

(58) Field of Search ..... 340/531, 539, 340/506, 505, 825.06, 825.07, 573.1; 713/201; 709/224; 702/186; 714/47; 455/405, 407; 348/14.03; 725/9, 10, 12

(56) References Cited

U.S. PATENT DOCUMENTS 4,980,913 A * 12/1990 Skret ..... 340/825.07
5,039,980 A * 8/1991 Aggers et al. ..... 340/506
5,457,689 A * 10/1995 Marvit et al. ..... 340/825.54
6,018,619 A * 1/2000 Allard et al. ..... 702/187
6,115,680 A * 9/2000 Coffee et al. ..... 702/187

* cited by examiner

*Primary Examiner*—Donnie L. Crosland

(57) ABSTRACT

A monitoring and notification system provides for monitoring of people based on a normal activity of a device associated with the monitored people. The monitoring and notification system includes a monitoring and notification device that is coupled to a network. A plurality of terminals are also coupled to the network and the monitoring and notification device monitors any number of the terminals. When an "inactivity event" of the monitored terminal(s) is detected, the monitoring and notification device notifies other ones of the terminals of the inactivity event.

27 Claims, 5 Drawing Sheets

MONITORING AND NOTIFICATION METHOD AND APPARATUS

BACKGROUND OF THE INVENTION

1. Field of Invention

This invention relates to monitoring terminals and notification of other terminals based on monitoring results.

2. Description of Related Art

Monitoring devices such as heart monitors and baby monitors commonly used in hospitals alert healthcare personnel when a monitor sensor detects abnormal activity. However, these monitors are not suitable for monitoring individuals living a normal life without being strapped by monitoring sensors which encumber normal activities. For example, if a family member would like to monitor an elderly grandmother (with her consent) who, while healthy, may encounter disabling conditions that may require assistance, then wiring the grandmother with sensors would be most undesirable. Thus, new technology is needed for non-intrusive monitoring of people.

SUMMARY OF THE INVENTION

A monitoring and notification system provides for monitoring of people based on activity of devices associated with the people being monitored. The monitoring and notification system includes a monitoring and notification device that is coupled to a network. A plurality of terminals (telephone stations, for example) are also coupled to the network and the monitoring and notification device monitors any number of the terminals. When an "inactivity event" is detected, the monitoring and notification device notifies other ones of the terminals of the inactivity event.

The monitoring and notification system may be operated by a monitoring and notification service having subscribers who identify monitored terminals and monitoring parameters. The monitoring and notification device performs a monitoring process based on the monitoring parameters. For example, the monitoring parameters may define an "inactivity event" of the monitored terminals by a time threshold which sets a limit since a last activity of the monitored terminals. If exceeded, the monitoring and notification device notifies the notification terminals.

The monitoring process may be controlled by a monitoring schedule that specifies periods of time when the monitored terminals should be monitored and when the monitored terminals should not be monitored. In addition, the monitored terminals may be separated into groups and a time threshold is associated with each of the groups.

The monitoring and notification device notifies the notification terminals according to a process specified by the subscriber who defines notification parameters such as an order, priority and manner in which the notification terminal are notified. A default notification terminal may also be specified so that if none of the other notification terminals responded to the notification, the default notification terminal (i.e., 911 rescue squad) is notified.

BRIEF DESCRIPTION OF THE DRAWINGS

The invention is described in connection with the following drawings, wherein like numerals represent like elements, and wherein.

DETAILED DESCRIPTION OF PREFERRED EMBODIMENTS

Figure 1:
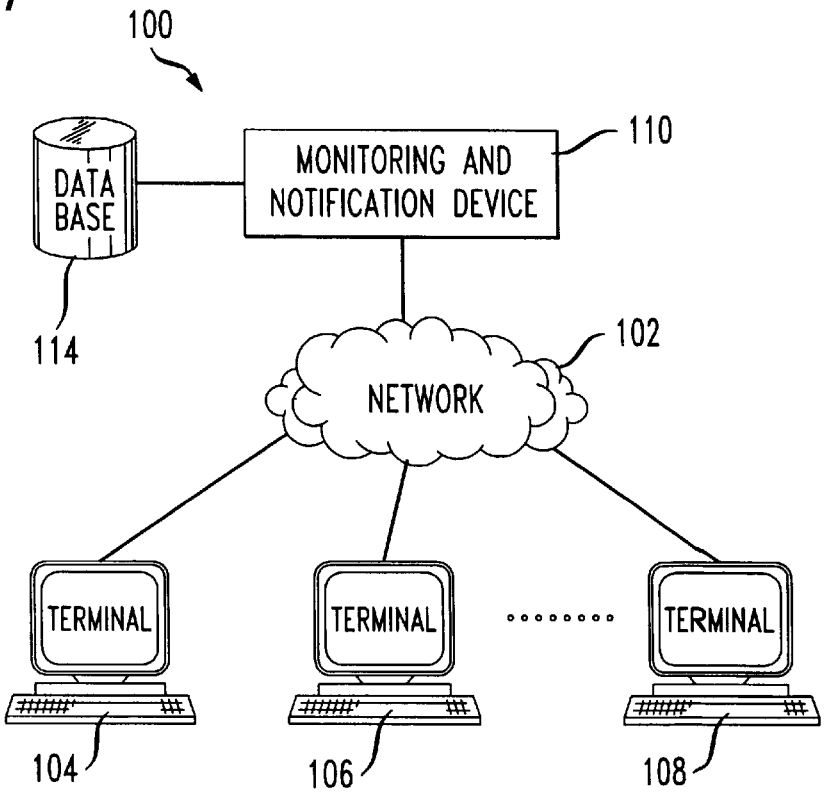
FIG. 1 is a diagram of a monitoring and notification system.

FIG. 1 shows a diagram of a monitoring and notification system 100 that includes a plurality of terminals such as terminals 104, 106, and 108 coupled together through a network 102 (wired or wireless). A monitoring and notification device 110 is also coupled to the network 102 and monitors activity of any number of specified terminals such as the terminals 104–108 to determine an "inactivity event" and notifies other ones of the terminals 104–108 when the inactivity event is detected.

The monitoring and notification device 110 monitors individuals by monitoring devices such as telephone stations (or cell phones) which are commonly used by those individuals. A person's normal activity may be correlated with the usage of these devices because devices such as telephone stations and personal computers are widely installed and often used. For a residential telephone station, the number of outgoing calls may be a good measure of "normal" activity of the people living in that residence, for example. Thus, the number of outgoing calls of a telephone station may be used as a proxy for a measure of the normality of the people using the telephone station.

If normal usage of a device such as a telephone station is assumed to represent the normality of an individual associated with the telephone station, then the lack of such usage would indicate abnormality of the individual. Thus, the monitoring and notification device determines that an abnormal circumstance may have occurred relative to an individual by detecting an inactivity of specified devices.

A monitoring and notification service provider may offer to subscribers an ability to monitor the activity of particular terminals and be notified when an inactivity event occurs. For example, a subscriber may desire to monitor a relative such as a grandmother and would like to be notified when the grandmother may need assistance. When subscribing to the service, the grandmother's telephone station (the terminal 104, for example) is identified as a monitored terminal and the subscriber's telephone station (the terminal 108, for example) is identified as a notification terminal. The identifiers of the monitored and notification terminals (telephone numbers, for example) may be stored in a database 114 which is coupled to the monitoring and notification device 110.

The subscriber may also specify a monitoring schedule as well as a definition of an "inactivity event". For example, the subscriber may specify monitoring the terminal 104 every day of the week except for Wednesdays and Sundays because during these days the grandmother attends church services for most of the day. The subscriber may also specify a time threshold after an outgoing call made by the terminal 104 so that an inactivity event occurs whenever the time after the outgoing call from the terminal 104 exceeds the time threshold before another outgoing call is made. An outgoing call may be defined as a call made for any reason other than responding to an incoming call.

The time threshold may relate to an average number of calls that the grandmother makes during an ordinary day. For example, if the grandmother normally makes approximately five calls to her friends every day between 10:00 am. and 7:00 p.m., then the time threshold may be set to a value greater than thirteen hours and perhaps less than nineteen hours assuming that a minimum time between calls is about an hour.

In the above example, during Mondays, Tuesdays, and Thursdays through Saturdays, the monitoring and notification device 110 monitors the terminal 104 for outgoing calls. Assuming that the time threshold is set at sixteen hours, the monitoring and notification device 110 monitors the terminal 104 for a time period of greater than sixteen hours after an outgoing call. If a period of "silence" (lack of another outgoing call) exceeds the time threshold of sixteen hours, the monitoring and notification device 110 notifies the terminal 108 (by calling the terminal 108, for example) to inform the subscriber that an "inactivity event" has occurred.

When such a notification is received, the subscriber may call the terminal 104 to contact the grandmother and assess whether an emergency condition has occurred. Thus, the monitoring and notification system 100 enables a subscriber to care for family members in a non-intrusive manner so that monitoring devices directly attached to the monitored persons are not required.

Figure 2:
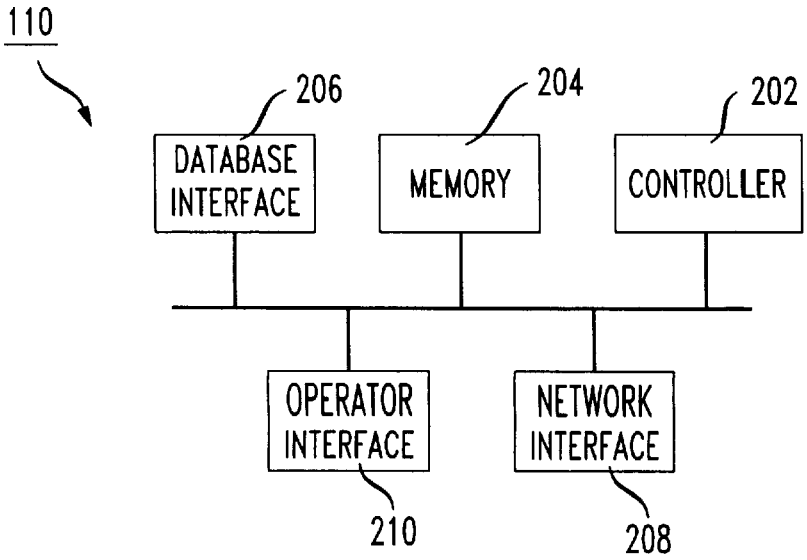
FIG. 2 is a block diagram of a monitoring and notification device.

FIG. 2 shows a blocked diagram of the monitoring and notification device 110. The monitoring and notification device 110 includes a controller 202, a memory 204, a database interface 206, a network interface 208 and an operator interface 210. The above components are coupled together via signal bus 212.

When the subscriber subscribes to the monitoring and notification service, the identifications (e.g., telephone numbers) of both the monitoring and the notification terminals are stored in the database 114. The database 114 may be accessed through the database interface 206 or from the memory 204. The place where the database 114 is stored is dependent on specific implementation circumstances. For the following discussion, it is assumed that the database 114 is stored in a storage device (not shown) external to the monitoring and notification device The storage device may be distributed throughout the network 102. The monitoring notification device 110 may access the database 114 via the database interface 206 through the network 102.

Figure 3:
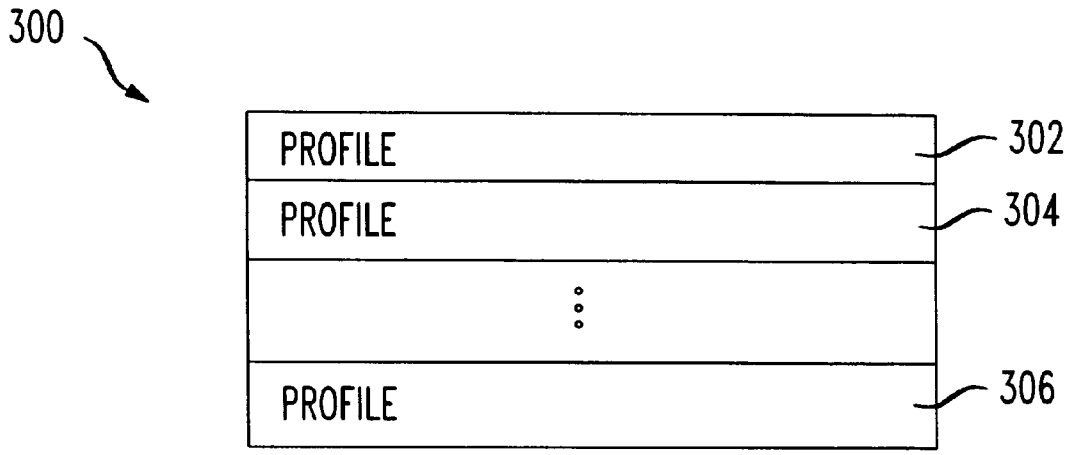
FIG. 3 is a diagram of a monitoring and notification database.

The database 114 may include a list 300 of profiles 302, 304, and 306, as shown in FIG. 3. Each profile 302–306 corresponds to a single monitoring and notification task. The monitoring and notification device 110 performs a monitoring and notification task as directed by each of the profiles 302–306.

Figure 4:
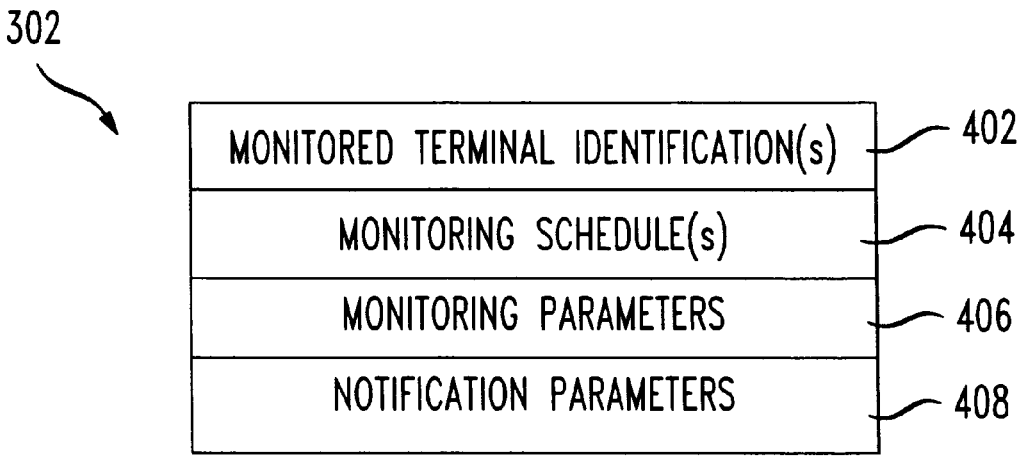
FIG. 4 is a diagram of a subscriber profile in the monitoring and notification database of FIG. 3.

An example of the contents of each of the profiles 302–306 is shown generically for profile 302 in FIG. 4. The profile 302 includes information such as monitored terminal identification 402, monitoring schedule 404, monitoring parameters 406 and notification parameters 408.

The monitored terminal identification 402 includes identification of all the terminals being monitored that are associated with an inactivity event. For example, a home (of the grandmother) may have three telephone lines. Two telephone lines are connected to two telephone stations or both telephone lines are connected to one telephone station while a third-telephone line is connected to a computer modem. Thus, to monitor the inactivity of the grandmother living in this particular residence, it may be necessary to monitor devices connected to all three telephone lines to determine whether an inactivity event has occurred. However, not all terminals may be desirable as monitored terminals. For example, if the grandmother uses the telephone stations far more frequently than the computer terminal, it is more reasonable to monitor only the telephone stations for inactivity because the frequency of use is much higher and the lack of use is a better proxy as an indication of possible abnormal circumstances encountered by the grandmother.

The identification of the monitored terminals in the monitored terminal identification 402 indicates the types of the monitored terminals. For example, the monitored terminals may be identified as telephone stations, pagers, or computers. Information may also be identified that relate to the monitored terminals for determining an activity of the monitored terminals. For example, the information may be telephone numbers for telephone stations, capcodes for pagers, or log on names for computers.

The monitoring and notification device 110 performs a monitoring process that is appropriate for each of the monitored terminals. For example, when monitoring a telephone station, the monitoring and notification device 110 may detect an off-hook signal that initiates an outgoing call. When monitoring a computer over the Internet, the monitoring and notification device 110 may detect whether the computer log on name was used to log on to a server of the Internet.

The monitoring schedule 404 contains information regarding when the terminals identified in the monitored terminal identification 402 should be monitored. As discussed earlier, the grandmother may not be at home on Wednesdays and Sundays. Other absences such as vacations, hospital stays and so on may also be indicated in the monitoring schedule 404. Thus, the monitoring and notification device 110 retrieves the monitoring schedule 404 to determine when monitoring of the monitored terminals identified in the monitored terminal identification 402 should occur and when the monitoring should not occur. The monitoring schedule 404 may be updated after initial entry by the subscriber as circumstances change. The subscriber may change the monitoring schedule 404 (or any other parameter) by calling the monitoring and notification service or by logging on to the monitoring and notification device 110 via the Internet, for example, and edit the profile 302–306.

The monitoring parameters 406 includes information such as the time threshold. A single time threshold or multiple time thresholds may be specified. If a single time threshold is specified, then activities from any one of the terminals identified in the monitored terminal identification 402 are used to determine the inactivity event. If multiple time thresholds are specified, then the terminals identified in the monitored terminal identification 402 are separated into groups where each of the time thresholds is associated with one of the groups. This allows tailoring of each time threshold to the characteristics of a particular type of monitored terminal. For example, a long time threshold may be associated with a less frequently used computer terminal while a short time interval may be associated with an often used telephone station. Thus, the time thresholds may be appropriately adjusted corresponding to each of the monitor terminals identified in the monitored terminal identification 402.

In addition, the monitor parameters 406 may be coordinated with the monitoring schedule 404. For example, certain devices may be used more often during the summer months while other devices may be more frequently used during the winter months. Thus, the time thresholds for each of the monitored terminals identified in the monitored terminal identification 402 may be correspondingly adjusted based on the monitoring schedule 404. If the grandmother lives in Maine during the summer months and in Florida during winter months, then the telephone stations of both residences may be identified as monitored terminals and the time threshold and monitoring schedule 404 are adjusted accordingly.

The notification parameters 408 specifies the notification terminals (e.g. telephone station, pagers, computers, etc.) as well as the notification process such as the order, priority and frequency of notification for each of the notification terminals. For example, the notification parameters 408 may identify first, second and third notification terminals. For the grandmother example discussed above, the first notification terminal may correspond to the family member that is primarily responsible for caring for the grandmother; the second notification terminal may correspond to a second family member that is a backup to the first family member; and the third notification terminal may correspond to the local rescue squad (i.e., 911). The notification parameters 408 may specify that the first notification terminal is notified first. The second and third notification terminals are not notified unless the first notification terminal does not respond to a notification from the monitoring and notification device 110.

Further, the notification parameters 408 may specify that the second notification terminal is not notified unless at least three attempts to notify the first notification terminal has failed. An attempt may be defined as calling the first notification terminal and waiting for five minutes before terminating the attempt, and waiting for at least an hour before a second attempt is made. If the first notification terminal failed to respond to all required attempts, then the notification and monitoring device 110 is directed to notify the second notification terminal with five attempts where each attempt is separated by eight hours. Finally, the third notification terminal is notified only if both the first and second notification terminals fail to respond.

If a notification terminal answers, then the monitoring and notification device 110 delivers a notification message to the notified terminal. The monitoring and notification device 110 may deliver the same notification message to all the notified terminals or different messages that is tailored to each of the notified terminals as specified in the notification parameters 408.

Other notification schemes may be applied such as simply notifying the first and second notification terminals in sequence until both the first and second notification terminals respond to the notification. The third notification terminal is reserved as a default notification terminal and is not contacted unless a limit such as a predetermined number of attempts has been completed or a predetermined amount of time has elapsed to the notify the first and second notification terminals. The The default notification terminals may include several notification terminals. For example, if the grandmother lives in Maine and Florida during the summer and winter months, respectively, then the notification parameter 408 may specify a main rescue squad telephone number for the summer months and a Florida rescue squad telephone number during the winter months.

The monitoring and notification device 110 may also provide live human operators to be notified when an inactivity event occurs. When such an option is elected, the monitoring and notification device 110 alerts the operator to notify the identified notification terminals and the operator contacts the notification terminals as specified in the notification parameter 408 which may be presented to the operator by the monitoring and notification device 110.

Returning to FIG. 2, the controller 202 determines when a monitoring process should be started or stopped by scanning the monitoring schedule 404 of each of the profiles 302–306. For example, the controller 202 may periodically retrieve the database 114 and examine each of the profiles 302–306 to determine whether the monitoring schedule 404 corresponding to each of the profiles 302–306 requires starting or stopping the monitoring process. Once started, the monitoring process continues for that profile 302–306 until the controller 202 stops the monitoring process and/or an inactivity event is detected.

When the monitoring process is started, the controller 202 retrieves the monitoring parameters 406 from the database 114 corresponding to the profiles 302–306 of the started monitoring task and sets a timer, for example. Then, the controller 202 monitors the monitored terminals identified in the monitored terminal identification 402 through the network interface 208 to detect an outgoing activity from each of the monitored terminals. For example, if a monitored terminal is a telephone station, the controller 202 detects an outgoing off-hook signal generated by the monitored terminal as an activity of the telephone station. An outgoing off-hook signal is generated when the telephone station goes off-hook to initiate a call as opposed to responding to a call from another party. Detecting only the outgoing off-hook signal prevents false indications of activity caused by answering machines taking the telephone station off-hook to receive a telephone message, for example.

If the monitored terminal is a personal computer, for example, the controller 202 may detect that the personal computer has logged on to an Internet service. The monitoring parameters 406 may specify a log on ID or a password and the controller 202 may detect whether the log on ID or password was used to log on to the network 102 through the network interface 208. In fact, the monitoring and notification device 110 may be implemented in an intranet of a corporation where the employer desires to monitor the active engagement of its employees. In this case, the monitoring and notification device 110 may be a server on a Local Area Network (LAN) that monitors activity of workstations by detecting disk access rates, for example.

Using the techniques described above, the controller 202 may detect when an activity has occurred. When an activity is detected, the controller 202 resets the timer to begin counting the time elapsed since the last activity of the monitor terminal. If the timer expires before an activity is detected, then the controller 202 generates an inactivity event and accesses the notification parameters 408 to begin the notification process.

For example, assume a simple notification scheme that requires all but one (default) of the notification terminals to be notified in a round robin manner. If at least one of the round robin notification terminals does not respond to the notification after a predetermined number of attempts, then the monitoring and notification device 110 notifies the last notification terminal as the default notification terminal.

The controller 202 may first generate a notification list which includes all the round robin notification terminals. Then, the controller 202 begins to notify all the notification terminals in the notification list in sequential order and removes each of the notification terminals from the notification list that responded to the notification. The controller 202 continues to notify the notification terminals that remain in the notification list until the list is empty or until a condition is triggered to notify the default notification for terminal. For example, the controller 202 may maintain a count of the number of times that the notifications has been attempted. If the count exceeds a maximum, the controller 202 notifies the default notification terminal which is assumed to always answer the notification (e.g., 911rescue squad) and stops notification of other notification terminals.

Figure 5:
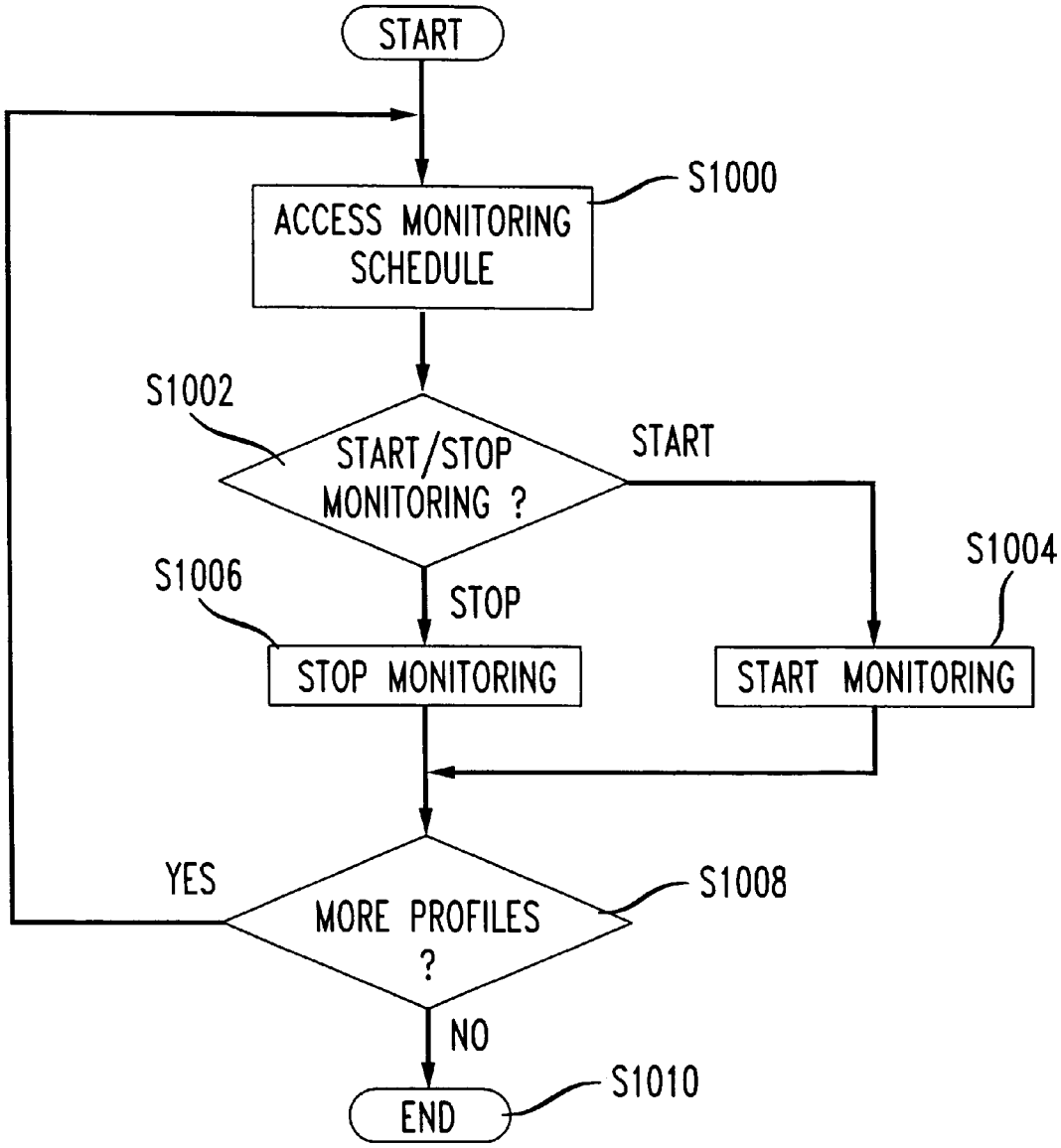
FIG. 5 shows a flowchart of a process for processing monitoring schedules.

FIG. 5 shows a flowchart of a process of the controller 202 for starting and stopping the monitoring process. Assuming that the database 114 is already retrieved, in step S1000, the controller 202 accesses the monitoring schedule 404 from the next profile 302–306, and goes to step S1002. In step S1002, the controller 202 determines whether the monitoring process should be started or stopped based on the monitoring schedule. If the monitoring process should be started, the controller 202 goes to step S1004; otherwise the controller 202 goes to step S1006.

In step S1004, the controller 202 starts the monitoring process and goes to step S1008. In step S1006, the controller 202 stops the monitoring process and goes to step S1008. In step S1008, the controller 202 determines whether more monitoring entries 302–306 remain. If more monitoring entries remain, the controller 202 returns to step S1000; otherwise the controller 202 goes to step S1010 and ends the process.

The process shown in FIG. 5 may be periodically repeated so that the schedules specified in the profiles 302–306 are faithfully followed. The time between successive executions of the process shown in FIG. 5 may be adjusted based on the time granularity of the monitoring schedules. For example, if the monitoring schedules specify monitoring start and stop times only on a daily bases, then the process shown in FIG. 5 need only be executed once a day.

Figure 6:
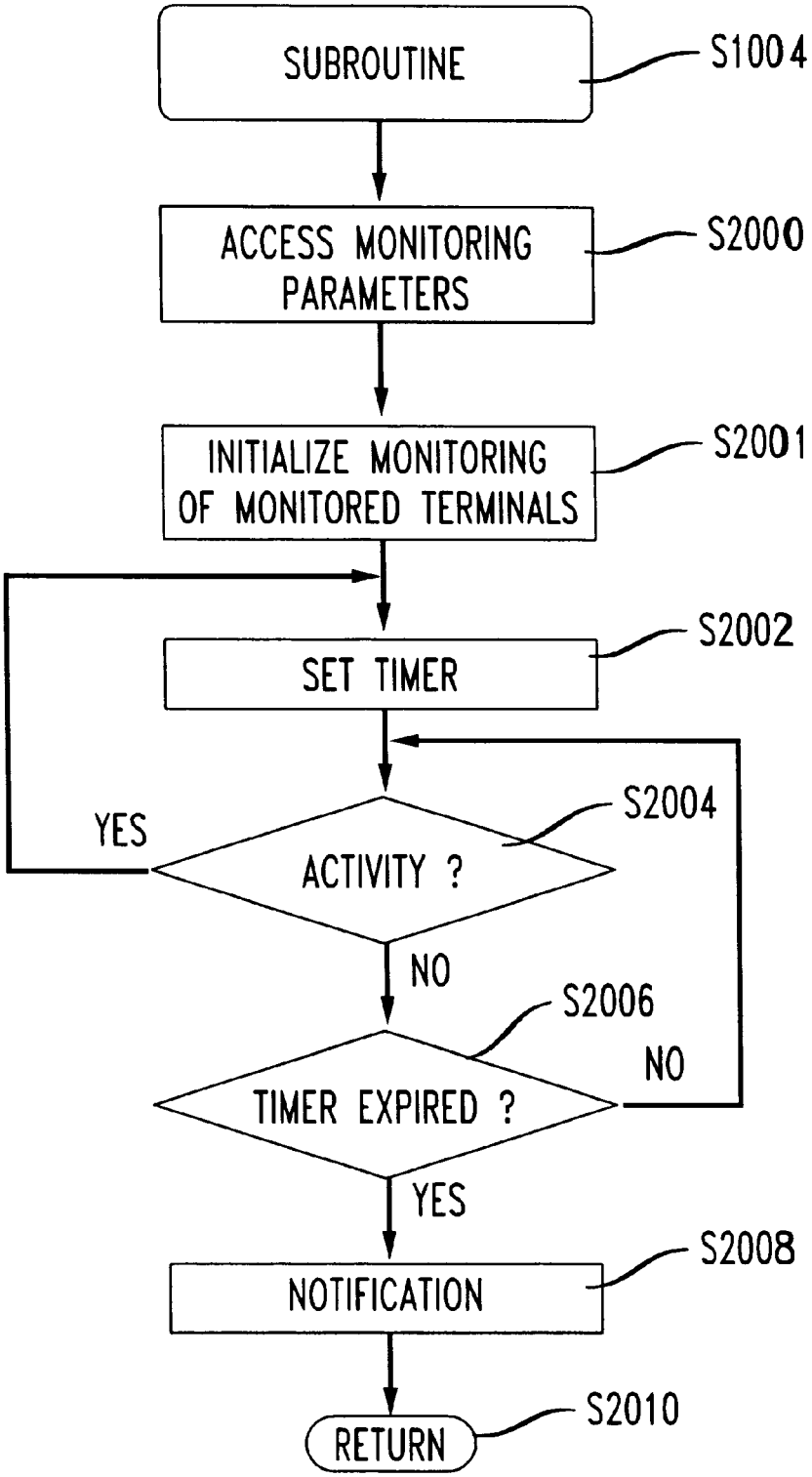
FIG. 6 shows a flowchart of a monitoring process.

FIG. 6 shows the start monitoring process of step S1004 in greater detail. In step S2000, the controller 202 accesses the monitoring parameters 406 and goes to step S2001. In step S2001, the controller 202 initializes the monitoring of the monitored terminals identified in the monitored terminals identification 402 and goes to step S2002. In step S2002, the controller 202 sets a timer and goes to step S2004. In step S2004, the controller 202 determines whether an activity of the monitored terminals has occurred according to the specification of the monitoring parameters 406. If activity has occurred, the controller 202 returns to step S2002 and resets the timer; otherwise, the controller goes to step S2006.

In step S2006, the controller 202 determines whether the timer has expired. If the timer has expired, the controller 202 goes to step S2008; otherwise the controller 202 returns to step S2004. In step S2008, the controller 202 begins the notification process and goes to step S2010 after the notification process is completed to return to step S1008 of FIG. 5.

Figure 7:
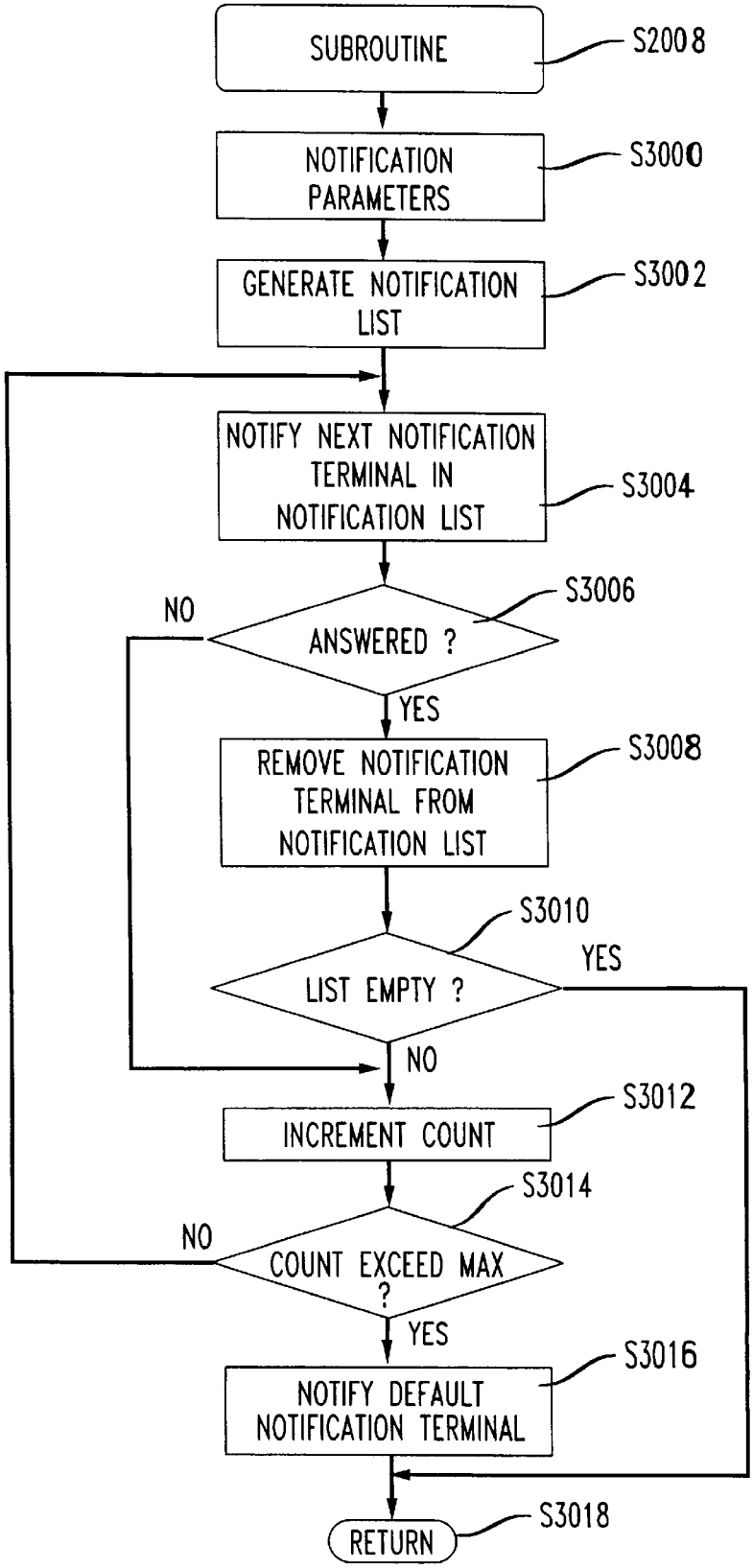
FIG. 7 shows a process for a notification process.

FIG. 7 shows the notification process of step S2008 in greater detail. In step S3000, the controller 202 accesses the notification parameters 408 and goes to step S3002. In step S3002 the controller 202 generates a notification list and goes to step S3004. In step S3004, the controller 202 notifies the next notification terminal in the notification list and goes to step S3006.

In step S3006, the controller 202 determines whether the notified notification terminal answered the notification (by going off-hook, for example). If an answer was received, the controller 202 goes to step S3008; otherwise, the controller 202 goes to step S3012. In step S3008, the controller 202 removes the notified notification terminal from the notification list and goes to step S3010. In step S3010, the controller 202 determines whether the notification list is empty. If empty, the controller 202 goes to step S3018 and returns to the calling process; otherwise, the controller 202 goes to step S3012.

In step S3012, the controller 202 increments a count and goes to step S3014. In step S3014, the controller 202 determines whether the count exceeded a maximum. If exceeded, the controller 202 goes to step S3016; otherwise, the controller 202 returns to step S3004. In step S3016, the controller 202 notifies the default notification terminal and goes to step S3018 to return to step S2010 of FIG. 6.

While this invention has been described in conjunction with specific embodiments thereof, it is evident that many alternatives, modifications, and variations will be apparent to those skilled in the art For example, the monitoring and notification device 110 has been discussed as a centralized unit. However, a distributive architecture may be used where the functions of the monitoring and notification device 110 are performed by servers of the network 102.

The monitoring and notification device 110 may be further distributed by co-locating it with the monitored terminals. One monitoring and notification device 110 may be installed for each physical location (e.g., the grandmother's house). In this case, each monitoring and notification device 110 may monitor only the terminals that are in the same physical location and thus multiple monitoring and notification devices 110 may be required to monitor terminals located in Maine and Florida, for example.

In fact, the monitoring and notification device function may be incorporated in the terminals themselves. For example, a telephone station may be able to detect when an outgoing call is initiated and commence the notification process when the time threshold is exceeded after an outgoing call. In this case, the concerned relative may purchase and install a "monitoring and notification" telephone station for the grandmother to achieve the same functionality as a network based monitoring and notification device 110.

In addition, even though examples of a telephone station and a personal computer are used as monitored terminals, activities of other devices may be monitored as indications of "normal" or "abnormal" status of an individual. For example, a cable box may be a monitored terminal and the activity may be channel selection changes made by the cable box. Further, devices other than communication devices may be monitored terminals such as kitchen appliances that are provided with usage sensors and associated network interfaces that facilitate monitoring by the monitoring and notification device 110 through the network 102.

Accordingly, preferred embodiments of the invention as set forth herein are intended to be illustrative not limiting. Various changes maybe made without departing from the spirit and scope of the invention as defined in the following claims.

What is claimed is:

1. A method for monitoring a person based on a network usage, comprising:

generating an activity record of the person by monitoring at least one device;

comparing the activity record of the person with an expected activity record to determine the existence of an inactivity event associated with the person;

generating an inactivity signal based on a profile and the inactivity event; and transmitting at least one notification message in the network if the inactivity signal is generated.

2. The method of claim 1, wherein the monitoring step comprises:

detecting whether the terminal generated a first signal; and generating a terminal active signal if the first signal is not in response to a second signal received by the terminal.

3. The method of claim 2, wherein the terminal is connected to a plurality of communication lines, the terminal active signal being generated after the first signal is generated on one of a portion of the communication lines as specified in a profile.

4. The method of claim 3, wherein the monitoring step monitors a plurality of terminals, the terminal active signal being generated after the first signal is generated on one of a portion of the terminals as specified in the profile.

5. The method of claim 3, wherein the profile includes a time threshold, the generating step generating the inactive signal when a time after an active signal is greater than the time threshold without the detection of another active signal.

6. The method of claim 5, wherein the profile identifies at least one notification terminal, the transmitting step transmitting the notification message to the notification terminal when the inactive signal is generated.

7. The method of claim 5, wherein the profile identifies a plurality of notification terminals, the transmitting step transmitting the notification message to each of the notification terminals.

8. The method of claim 7, wherein the transmitting step transmits the notification message to each of the notification terminals until either each of the notification terminals answers or a limit is reached, the limit being included in the profile.

9. The method of claim 8, wherein the transmitting step transmits the notification message to a default notification terminal after the limit is reached.

10. The method of claim 8, wherein the limit is either a predetermined time interval or a predetermined number of times.

11. The method of claim 1, wherein the at least one terminal includes at least one of a telephone station and a computer.

12. The method of claim 1, wherein the notification message is transmitted by either a monitoring and notification device or an operator.

13. A system that monitors a person's usage of a network, comprising:

a controller generating an activity record of the person by monitoring at least one device, coupled to the network, wherein the activity record of the person is compared with an expected activity record to determine the existence of an inactivity event associated with a person, wherein an inactivity signal is generated based on a profile and the inactivity event, and wherein at least one notification message is transmitted in the network if the inactivity signal is generated.

14. The system of claim 13, wherein the monitoring and notification device detects whether the terminal generated a first signal, and generates a terminal active signal if the first signal is not in response to a second signal received by the terminal.

15. The system of claim 14, wherein the terminal is connected to a plurality of communication lines, the terminal active signal being generated after the first signal is generated on one of a portion of the communication lines as specified in a profile.

16. The system of claim 15, wherein the monitoring and notification device monitors a plurality of terminals, the terminal active signal being generated after the first signal is generated on one of a portion of the terminals as specified in the profile.

17. The system of claim 15, wherein the profile includes a time threshold, the monitoring and notification device generating the inactive signal when a time after an active signal is greater than the time threshold without the detection of another active signal.

18. The system of claim 17, wherein the profile identifies at least one notification terminal, the monitoring and notification device transmitting the notification message to the notification terminal when the inactive signal is generated.

19. The system of claim 17, wherein the profile identifies a plurality of notification terminals, the monitoring and notification device transmitting the notification message to each of the notification terminals.

20. The system of claim 19, wherein the monitoring and notification device transmits the notification message to each of the notification terminals until either each of the notification terminals answers or a limit is reached, the limit being included in the profile.

21. The system of claim 20, wherein the monitoring and notification device transmits the notification message to a default notification terminal after the limit is reached.

22. The system of claim 20, wherein the limit is either a predetermined time interval or a predetermined number of times.

23. The system of claim 13, wherein the at least one terminal includes at least one of a telephone station and a computer.

24. The system of claim 13, wherein the notification message is transmitted by either a monitoring and notification device or an operator.

25. The system of claim 13, wherein the monitoring and notification device is incorporated in the terminal being monitored.

26. The system of claim 13, wherein the network includes a wired network or a wireless network or a combination of both, and the terminals are coupled to the network through wired connections or wireless connections.

27. A system that monitors a person's usage of a network, comprising:

monitoring means to generate an activity record of the person by monitoring at least one device coupled to the network;

comparison means to compare the activity record of the person with an expected activity record to determine the existence of an inactivity event associated with a person;

generation means for an inactivity signal based on a profile and the inactivity event; and transmission means for at least one notification message in the network if the inactivity signal is generated.

* * * * *